US010071388B2

(12) United States Patent
Escoto, Jr. et al.

(10) Patent No.: US 10,071,388 B2
(45) Date of Patent: Sep. 11, 2018

(54) LIQUID SPRAY GUN, SPRAY GUN PLATFORM, AND SPRAY HEAD ASSEMBLY

(71) Applicant: 3M INNOVATIVE PROPERTIES COMPANY, St. Paul, MN (US)

(72) Inventors: John I. Escoto, Jr., St. Paul, MN (US); Daniel E. Siltberg, White Bear Township, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 13 days.

(21) Appl. No.: 14/933,432

(22) Filed: Nov. 5, 2015

(65) Prior Publication Data

US 2016/0052003 A1 Feb. 25, 2016

Related U.S. Application Data

(63) Continuation of application No. 14/030,064, filed on Sep. 18, 2013, which is a continuation of application No. 12/693,777, filed on Jan. 26, 2010, now Pat. No. 8,590,809.

(60) Provisional application No. 61/147,343, filed on Jan. 26, 2009.

(51) Int. Cl.

| | |
|---|---|
| ***B05B 7/24*** | (2006.01) |
| ***B05B 7/06*** | (2006.01) |
| ***B05B 7/08*** | (2006.01) |
| ***B05B 12/00*** | (2018.01) |

(52) U.S. Cl.

CPC ..... *B05B 7/2478* (2013.01); *B05B 7/066* (2013.01); *B05B 7/0815* (2013.01); *B05B 7/247* (2013.01); *B05B 12/002* (2013.01)

(58) Field of Classification Search

CPC ..... B05B 7/247; B05B 7/24788; B05B 7/066; B05B 7/0815; B05B 12/002

USPC ..... 239/379, 526, 290, 291

See application file for complete search history.

(56) References Cited

U.S. PATENT DOCUMENTS

| | | | |
|---|---|---|---|
| 1,299,290 | A | 4/1919 | Berg |
| 1,539,536 | A | 5/1925 | Bartling |
| 1,748,440 | A | 2/1930 | Burdick |
| 2,042,746 | A | 6/1936 | Tracy |
| 2,059,706 | A | 11/1936 | Paasche |
| 2,126,888 | A | 8/1938 | Jenkins |
| 2,303,280 | A | 11/1942 | Jenkins |
| 2,362,946 | A | 11/1944 | Stockdale |
| 2,497,625 | A | 2/1950 | Norwick |
| 2,820,670 | A | 1/1958 | Charlop |
| 2,886,252 | A | 5/1959 | Ehrensperger |
| 2,904,262 | A | 9/1959 | Peeps |
| 2,991,940 | A | 7/1961 | Dupler |

(Continued)

FOREIGN PATENT DOCUMENTS

| | | |
|---|---|---|
| CN | 1280885 | 1/2001 |
| CN | 2431971 | 5/2001 |

(Continued)

OTHER PUBLICATIONS

PCT International Search Report for PCT/US2010/022101, dated Aug. 3, 2010.

Ihmels, Manfred, Ihmels Article—SATA, Feb. 15, 1989, 2 pages.

*Primary Examiner* — Jason Boeckmann

(57) ABSTRACT

Liquid spray gun platforms, spray head assemblies and liquid spray guns including one or both of the spray gun platforms and the spray head assemblies are described.

17 Claims, 8 Drawing Sheets

(56) References Cited

U.S. PATENT DOCUMENTS 3,062,453 A 11/1962 Matthews
3,157,360 A 11/1964 Heard
3,168,250 A 2/1965 Paasche
3,236,459 A 2/1966 McRitchie
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos et al.
4,403,738 A 9/1983 Kern
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A 1/1993 Rodgers
5,242,115 A 9/1993 Brown
5,279,461 A 1/1994 Darroch
5,280,853 A 1/1994 Perret
5,322,221 A 6/1994 Anderson
5,332,156 A 7/1994 Wheeler
5,395,046 A 3/1995 Knobbe
5,454,517 A 10/1995 Naemura
5,456,414 A 10/1995 Burns
5,474,450 A 12/1995 Chronister
5,582,350 A 12/1996 Kosmyna
5,607,108 A 3/1997 Garlick
5,609,302 A 3/1997 Smith
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A 5/2000 Ruta
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 2/2004 Van der Steur
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,237,727 B2 7/2007 Wang
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 * 2/2009 Joseph ..... B05B 7/2435 239/290
7,694,896 B2 4/2010 Turnbull
D616,527 S 5/2010 Anderson
7,712,682 B2 5/2010 Joseph
7,767,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 * 4/2011 Fox ..... B05B 1/3046 239/291
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
8,684,281 B2 4/2014 Micheli
2002/0104898 A1 8/2002 Bonninque
2003/0071144 A1 4/2003 Naemura
2003/0111553 A1 6/2003 Hunter
2003/0173419 A1 9/2003 Huang
2004/0089742 A1 6/2004 Antonucci
2004/0140373 A1 7/2004 Joseph
2004/0195401 A1 10/2004 Strong
2004/0245673 A1 12/2004 Allsop
2004/0256484 A1 12/2004 Joseph
2004/0256493 A1 12/2004 Turnbull
2005/0016448 A1 1/2005 Dilou
2005/0035220 A1 2/2005 Brown
2005/0045741 A1 3/2005 Brown
2005/0087128 A1 4/2005 Jakupovic
2005/0145724 A1 * 7/2005 Blette ..... B05B 7/02 239/525
2005/0173561 A1 8/2005 Cotter
2006/0000927 A1 1/2006 Ruda
2006/0065761 A1 3/2006 Joseph
2006/0097070 A1 5/2006 Huffman
2006/0102550 A1 5/2006 Joseph
2006/0175433 A1 8/2006 Escoto, Jr.
2006/0186223 A1 8/2006 Wang
2007/0102535 A1 5/2007 Carey
2007/0262169 A1 11/2007 Wang
2007/0262172 A1 11/2007 Huffman
2008/0078849 A1 4/2008 Fox
2008/0093479 A1 4/2008 Delbridge
2008/0272213 A1 11/2008 Ting
2009/0026290 A1 1/2009 Fox
2009/0121048 A1 5/2009 Noshima
2009/0302133 A1 12/2009 Micheli
2010/0108783 A1 5/2010 Joseph
2010/0123024 A1 5/2010 Gohring
2010/0133358 A1 6/2010 Gohring
2010/0187333 A1 7/2010 Escoto, Jr.

(56) References Cited

U.S. PATENT DOCUMENTS

| | | | |
|---|---|---|---|
| 2010/0282888 | A1 | 11/2010 | Heigl |
| 2011/0168811 | A1 | 7/2011 | Fox |
| 2013/0092760 | A1 | 4/2013 | Joseph |
| 2013/0327850 | A1 | 12/2013 | Joseph |
| 2014/0014741 | A1 | 1/2014 | Escoto |
| 2014/0246519 | A1 | 9/2014 | Johnson |
| 2015/0028131 | A1 | 1/2015 | Joseph |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 4302911 | 8/1993 |
| DE | 19503495 | 8/1996 |
| DE | 19605227 | 8/1997 |
| DE | 10315426 | 6/2004 |
| DE | 60005536 | 7/2004 |
| DE | 102004027789 | 2/2005 |
| DE | 102004044475 | 12/2005 |
| DE | 102007012989 | 10/2007 |
| DE | 202011050102 | 8/2011 |
| EP | 279992 | 8/1988 |
| EP | 0492333 | 7/1992 |
| EP | 509367 | 10/1992 |
| EP | 0885658 | 12/1998 |
| EP | 1340550 | 9/2003 |
| EP | 1479447 | 11/2004 |
| EP | 1554051 | 4/2006 |
| EP | 1682231 | 7/2006 |
| EP | 1699565 | 6/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H1028906 | 2/1998 |
| JP | 11-114458 | 4/1999 |
| JP | 20021169 | 1/2002 |
| JP | 2003112086 | 4/2003 |
| JP | 2005211699 | 8/2005 |
| JP | 2007175650 | 7/2007 |
| KR | 10-0435685 | 6/2004 |
| KR | 20-0428831 | 10/2006 |
| NL | 1024774 | 3/2004 |
| RU | 2014906 | 6/1994 |
| RU | 2060383 | 5/1996 |
| SU | 172206 | 1/1965 |
| SU | 172206 | 7/1965 |
| SU | 1111832 | 9/1984 |
| SU | 1423175 | 9/1988 |
| SU | 1613181 | 12/1990 |
| WO | WO 03/051524 | 6/2003 |
| WO | WO 2004/037432 | 5/2004 |
| WO | WO 2004/037433 | 5/2004 |
| WO | WO 2004/087332 | 10/2004 |
| WO | WO 2005/049145 | 6/2005 |
| WO | WO 2005/063361 | 7/2005 |
| WO | WO 2006/053229 | 5/2006 |
| WO | WO 2006/098623 | 9/2006 |
| WO | WO 2006/107935 | 10/2006 |
| WO | WO 2007/056589 | 5/2007 |
| WO | WO 2007/104967 | 9/2007 |
| WO | WO 2007/139639 | 12/2007 |
| WO | WO 2008/016557 | 2/2008 |
| WO | WO 2009/113980 | 9/2009 |
| WO | WO 2012/109298 | 8/2012 |
| WO | WO 2013/016474 | 1/2013 |
| WO | WO 2013/055730 | 4/2013 |
| WO | WO 2015/009475 | 1/2015 |

* cited by examiner

LIQUID SPRAY GUN, SPRAY GUN PLATFORM, AND SPRAY HEAD ASSEMBLY

RELATED APPLICATION

This application is a continuation of U.S. Ser. No. 14/030,064, filed Sep. 18, 2013, which is a continuation of U.S. Ser. No. 12/693,777, filed Jan. 26, 2010, which claims the benefit under 35 U.S.C. § 119 of U.S. Provisional Application No. 61/147,343, filed on Jan. 26, 2009, titled LIQUID SPRAY GUN, which applications are hereby incorporated by reference in their entireties.

Liquid spraying apparatus such as liquid spray guns, liquid spray gun platforms, and spray head assemblies are described herein.

Spray guns are widely used in vehicle body repair shops when re-spraying a vehicle with liquid coating media, e.g., primer, paint and/or clearcoat. Typically the spray gun is made of a solid metal body and an integral handle, which are bored out to form a compressed air inlet, air passageways, a liquid nozzle assembly, and to accept a trigger mechanism for releasing the liquid to an air cap for discharge of the liquid in the form of an atomized spray. During use, the coating media may accumulate on the exterior and interior surfaces of the gun. Unless thoroughly cleaned between operations, dried coating media will accumulate, thereby adversely affecting spraying performance, and possibly contaminating subsequent applications.

The air cap and liquid nozzle assemblies may be detachable so that they may be removed and disassembled for cleaning and subsequent reuse. Some air cap and liquid nozzle assemblies are manufactured of plastic and are intended to be disposed of after a single use. A unitary metal gun body and handle however is not amenable to either disassembly or single use applications. Removing residual dried spray material and solvent from the typical metal spray gun therefore remains a tedious and time consuming operation for the user but one that is necessary in order to maintain the spray gun in optimal working condition and to avoid contaminating subsequent spray applications with dislodged dried spray material To overcome these shortcomings, some manufacturers have constructed spray guns out of molded, solvent-resistant plastic. Depending on the intended use and sophistication, the guns are typically assembled from two halves of a solid body and/or outer shell. The mirror image forms may be permanently fused together or may be coupled using mechanical fasteners such as screws and/or snap-fit tabs. The former construction method lends itself to disposable guns while the latter method provides for disassembly and reuse. The latter may also provide for modular interchangeable air and liquid management sub-assemblies. Even so, reassembly of the gun body requires careful repositioning of the various air and liquid passageway seals.

SUMMARY

Liquid spray guns including a spray gun platform and a spray head assembly are described herein. In some embodiments, the spray gun platforms may be constructed of a molded plastic frame assembly and a spray head assembly that can be used to deliver both air and the liquid to be sprayed in a manner that results in an acceptable spray coating.

The spray gun platforms described herein include air passages for delivering compressed air to a spray head assembly attached to the spray gun platform. The spray gun platforms may include an air supply manifold that delivers air to a fan control air passage and a center air passage, wherein the fan control air passage and the center air passage are isolated from each other after separating at the air supply manifold.

The spray head assemblies described herein are preferably constructed to receive air from the fan control air passage and the center air passage of a spray gun platform to which they are attached. The spray head assembly includes a fan control air chamber that receives the fan control air from a fan control air passage in an attached spray gun platform and a center air chamber that receives the center air from a center air passage in an attached spray gun platform.

The liquid spray gun platforms described herein may have fan control air passages, center air passages, and/or air supply manifolds that can be described with respect to relative volumetric relationships and/or dimensions. The spray gun platforms described herein may have significantly increased air passage dimensions. Although the actual volumes of the different features in the spray gun platforms may vary in different embodiments, the volumes of the features in the spray gun platforms may be characterized relative to each other. For example, in some embodiments, the fan control air passage in the spray gun platform may have a volume that is larger than a volume of the center air passage. In some embodiments, the volume of the fan control air passage may be 120% or more of the volume of the center air passage. In other embodiments, the volume of the fan control air passage may be 150% or more of the volume of the center air passage.

The spray gun platforms described herein may, in some embodiments, be characterized in relative volumetric terms where the volume of the fan control air passage and the volume of the center air passage together are less than the volume of the air supply manifold. Although the combined volumes of the fan control air passage and the center air passage may be less than the volume of the air supply manifold in some embodiments, they may still have some lower limit. For example, in some embodiments, the volume of the fan control air passage and the volume of the center air passage together may be 50% or more of the volume of the air supply manifold. In other embodiments, the volume of the fan control air passage and the volume of the center air passage together are 60% or more of the volume of the air supply manifold. In still other embodiments, the volume of the fan control air passage and the volume of the center air passage together are 70% or more of the volume of the air supply manifold.

The spray head assemblies described herein may, in some embodiments, be characterized in terms of relative volumetric relationships and/or dimensions. For example, in some embodiments, the center air chamber of the spray head assemblies described herein may have a volume that is greater than a volume of the fan control air chamber formed in the spray head assembly. In some embodiments, the center air chamber of the spray head assembly may have a volume that is 200% or more of the volume of the fan control air chamber in the spray head assembly. In other embodiments, the center air chamber of the spray head assembly may have a volume that is 300% or more of the volume of the fan control air chamber.

In some embodiments, the volumes of the air flow features in a spray gun platform to which the spray head assembly is attached may be characterized together with the volumes of the features in the spray head assembly. The combined volumes may potentially offer some of the advantages in spray performance of a liquid spray gun.

For example, in some embodiments of a liquid spray gun (which includes a spray gun platform and a spray head assembly as described herein) the spray head assembly may have a center air chamber with a volume that is greater than the volume of the fan control air chamber in the spray head assembly. That volumetric relationship may, in some embodiments, be paired with a spray gun platform in which a fan control air passage has a volume that is larger than the volume of the center air passage through the spray gun platform.

In other embodiments of a liquid spray gun as described herein, a spray head assembly with a center air chamber with a volume that is greater than the volume of the fan control air chamber in the spray head assembly may be paired with a spray gun platform in which a fan control air passage and the fan control air chamber in the spray head assembly taken together have a combined volume that is less than a combined volume of the center air passage in the spray gun platform and the center air chamber in the spray head assembly.

In still other embodiments of a liquid spray gun as described herein, a spray head assembly with a center air chamber with a volume that is greater than the volume of the fan control air chamber in the spray head assembly may be paired with a spray gun platform in which the fan control air passage in the platform and the fan control air chamber in the spray head assembly taken together have a combined volume that is 75% or less of a combined volume of a center air passage in the spray gun platform and the center air chamber in the spray head assembly.

In still other embodiments of a liquid spray gun as described herein, a spray head assembly with a center air chamber with a volume that is greater than the volume of the fan control air chamber in the spray head assembly may be paired with a spray gun platform in which the fan control air passage in the platform and the fan control air chamber in the spray head assembly taken together have a combined volume that is 50% or less of a combined volume of a center air passage in the spray gun platform and the center air chamber in the spray head assembly.

In still other embodiments of a liquid spray gun as described herein, a spray head assembly with a center air chamber with a volume that is greater than the volume of the fan control air chamber in the spray head assembly may be paired with a spray gun platform in which the volume of a fan control air passage in the spray gun platform and the volume of a center air passage in the spray gun platform taken together are less than the volume of an air supply manifold in the spray gun platform.

Although described herein in combination with each other, the liquid spray gun platforms and the spray head assemblies described herein may each be used separately with other components to provide a liquid spray gun. For example, the liquid spray gun platforms described herein could be used with any spray head assembly that was designed to operably connect to the barrel interface of the liquid spray assembly. Similarly, the spray head assemblies could be used with other liquid spray gun platforms that have a barrel interface designed to accept the spray head assemblies described herein.

The liquid spray guns, spray gun platforms, and spray head assemblies described herein may be used in a liquid spray delivery system in which a container of the liquid to be dispensed is mounted on the spray head assembly. The liquid container may preferably be detachable from the spray head assembly, which is also detachable from the spray gun platform. By connecting the container to the spray head assembly and arranging for the spray head assembly to be detachable from the spray gun platform, liquid withdrawn from the container in use is delivered to a nozzle in the spray head assembly without passing through the spray gun platform. In this way, the extent to which the spray gun platform is contaminated by the liquid media, and the amount of cleaning required on completion of spraying or when changing over the spray gun to spray another media may be reduced.

The spray head assemblies described herein are adapted to atomize a liquid to form a spray. For example, the spray head assembly may be arranged to mix the liquid emerging from a nozzle with a supply of compressed air. Liquid emerging from the nozzle is mixed with air streams directed on the liquid from two sides to atomize the liquid and shape the spray pattern. The air streams may be adjusted to adapt the spray head assembly for dispensing different media. Although the spray head assemblies described herein are provided as a composite article formed using a barrel and an air cap assembled on the barrel, in other embodiments, the spray head assemblies may be provided as a unitary "all-in-one" article.

The liquid spray guns, spray gun platforms, and spray head assemblies described herein may preferably be sized for use as a hand-held spray gun and may be used in methods that involve the spraying of one or more selected liquids using the liquid spray guns, spray gun platforms, and spray head assemblies described herein.

In one aspect, some embodiments of the liquid spray gun platforms described herein include: a frame having a barrel interface; an air supply manifold contained within the frame, the air supply manifold including an inlet port; a fan control air passage in fluid communication with the air supply manifold, the fan control air passage extending through the frame from an inlet end at the air supply manifold to an outlet end at the barrel interface; a center air passage in fluid communication with the air supply manifold, the center air passage extending through the frame from an inlet end at the air supply manifold to an outlet end at the barrel interface; wherein the fan control air passage comprises a volume that is larger than a volume of the center air passage.

In some embodiments of the liquid spray gun platforms described herein, the volume of the fan control air passage is 120% or more of the volume of the center air passage. On other embodiments, the volume of the fan control air passage is 150% or more of the volume of the center air passage.

In some embodiments of the liquid spray gun platforms described herein, the volume of the fan control air passage and the volume of the center air passage together are less than a volume of the air supply manifold. In some embodiments, the volume of the fan control air passage and the volume of the center air passage together are 50% or more of a volume of the air supply manifold. In other embodiments, the volume of the fan control air passage and the volume of the center air passage together are 60% or more of a volume of the air supply manifold. In still other embodiments, the volume of the fan control air passage and a volume of the center air passage together are 70% or more of a volume of the air supply manifold.

In some embodiments of the liquid spray gun platforms described herein, the frame includes a central body and a cover plate attached to the central body to define at least a portion of one of the fan control air passage and the center air passage through the frame. In some embodiments, the cover plate is attached to the central body along an air passage weld line, wherein the air passage weld line follows a raised rib in the cover plate, and wherein the raised rib forms a closed geometric figure on the cover plate.

In some embodiments of the liquid spray gun platforms described herein, the frame includes a central body, a first cover plate, and a second cover plate; wherein the first cover plate is attached to a first side of the central body to define at least a portion of the fan control air passage through the frame; and wherein the second cover plate is attached to a second side of the central body to define at least a portion of the center air passage through the frame. In some embodiments, the central body, the first cover plate, and the second cover plate are constructed of molded plastic. In some embodiments, the first cover plate is attached to the central body along a fan control air passage weld line, wherein the fan control air passage weld line follows a raised rib on the first cover plate, wherein the raised rib forms a closed geometric figure on the first cover plate, and the second cover plate is attached to the central body along a center air passage weld line, wherein the center air passage weld line follows a raised rib on the second cover plate, wherein the raised rib forms a closed geometric figure on the second cover plate.

In a first aspect, some embodiments of the liquid spray head assemblies described herein include a barrel and an air cap attached to the barrel. The spray head assemblies further include a liquid passageway in the barrel, wherein the liquid passageway extends from an inlet end to a liquid nozzle opening; a center air chamber that extends from a barrel inlet to a center air outlet, wherein the center air outlet is formed between a nozzle aperture in the air cap that surrounds the liquid nozzle opening of the barrel, wherein the center air chamber includes a nozzle cavity located between the air cap and the barrel, a barrel cavity located within the barrel, and a plurality of openings formed in the barrel through which air passes into the nozzle cavity from the barrel cavity for delivery to the center air outlet during use of the spray head assembly, and wherein the nozzle cavity, the liquid nozzle opening, and the nozzle aperture are shaped to direct air under greater than atmospheric pressure against liquid flowing out of the liquid nozzle opening to propel the liquid away from the liquid nozzle opening while shaping the liquid into a generally conical stream about an axis extending through the liquid nozzle opening; and a fan control air chamber that extends from an inlet end of a fan control barrel passage formed in the barrel to apertures located on horns projecting past the liquid nozzle opening, wherein the apertures in the horns are located on opposite sides of the axis such that air flowing through the fan control air chamber under greater than atmospheric pressure flows against opposite sides of a stream of liquid formed by air flowing through the center air chamber. The center air chamber of the spray head assembly has a volume that is greater than a volume of the fan control air chamber.

In some embodiments of the first aspect of the spray head assemblies described herein, the volume of the center air chamber of the spray head assembly is 200% or more of the volume of the fan control air chamber. In other embodiments, the volume of the center air chamber of the spray head assembly is 300% or more of the volume of the fan control air chamber.

In some embodiments of the first aspect of the spray head assemblies described herein, the barrel includes a barrel frame and a seal element. The barrel frame includes a connection tab that includes an aperture formed in a wall of the barrel frame; a lever element located within the aperture, wherein the lever element has a first end connected to the barrel frame, a free end, and a pair of side edges extending from the first end towards the free end; wherein the seal element closes the aperture around the side edges and the free end of the lever element of the connection tab.

In some embodiments of the first aspect of the spray head assemblies described herein, the barrel frame is constructed from a first plastic and the seal element is constructed of a second plastic, wherein the second plastic of the seal element is attached to the first plastic of the barrel frame. In some embodiments, the aperture includes an opening formed through the wall of the barrel frame, and the connection tab includes a strut connecting a side edge of the lever element to an opposing edge of the aperture, wherein the strut is located closer to the free end of the lever element than the first end of the lever element, and wherein the aperture is open around the lever element in the absence of the second plastic of the seal element. In some embodiments, the strut is formed of the first plastic and is encased within the second plastic of the seal element.

In a second aspect, some embodiments of the liquid spray head assemblies described herein include a barrel and an air cap attached to the barrel. The spray head assemblies further include: a liquid passageway in the barrel, wherein the liquid passageway extends from an inlet end to a liquid nozzle opening; a center air chamber that extends from a barrel inlet to a center air outlet, wherein the center air outlet is formed between a nozzle aperture in the air cap that surrounds the liquid nozzle opening of the barrel, wherein the center air chamber includes a nozzle cavity located between the air cap and the barrel, a barrel cavity located within the barrel, and a plurality of openings formed in the barrel through which air passes into the nozzle cavity from the barrel cavity for delivery to the center air outlet during use of the spray head assembly, and wherein the nozzle cavity, the liquid nozzle opening, and the nozzle aperture are shaped to direct air under greater than atmospheric pressure against liquid flowing out of the liquid nozzle opening to propel the liquid away from the liquid nozzle opening while shaping the liquid into a generally conical stream about an axis extending through the liquid nozzle opening; and a fan control air chamber that extends from an inlet end of a fan control barrel passage formed in the barrel to apertures located on horns projecting past the liquid nozzle opening, wherein the apertures in the horns are located on opposite sides of the axis such that air flowing through the fan control air chamber under greater than atmospheric pressure flows against opposite sides of a stream of liquid formed by air flowing through the center air chamber. The barrel includes a barrel frame and a seal element. The barrel frame includes a connection tab that includes: an aperture formed in a wall of the barrel frame, wherein the barrel frame has a continuous inlet end edge defining a closed perimeter; a lever element located within the aperture, wherein the lever element has a first end connected to the barrel frame, a free end, and a pair of side edges extending from the first end towards the free end. The seal element closes the aperture around the side edges and the free end of the lever element of the connection tab.

In some embodiments of the second aspect of the spray head assemblies described herein, the center air chamber of the spray head assembly has a volume that is greater than a volume of the fan control air chamber. In some embodiments, the center air chamber of the spray head assembly has a volume that is 200% or more of a volume of the fan control air chamber. In other embodiments, the center air chamber of the spray head assembly has a volume that is 300% or more of a volume of the fan control air chamber.

In some embodiments of the second aspect of the spray head assemblies described herein, the barrel frame is constructed from a first plastic and the seal element is constructed of a second plastic, wherein the second plastic of the seal element is attached to the first plastic of the barrel frame. In some embodiments, the aperture includes an opening formed through the wall of the barrel frame, and the connection tab includes a strut connecting a side edge of the lever element to an opposing edge of the aperture, wherein the strut is located closer to the free end of the lever element than the first end of the lever element, and wherein the aperture is open around the lever element in the absence of the second plastic of the seal element. In some embodiments, the strut is formed of the first plastic and is encased within the second plastic of the seal element.

In some embodiments of the second aspect of the spray head assemblies described herein, the barrel frame is constructed from a first plastic and the seal element is constructed of a second plastic, wherein the second plastic of the seal element is attached to the first plastic of the barrel frame. Further, the aperture includes an opening formed through the wall of the barrel frame, and the connection tab includes a first strut connecting a first side edge of the lever element to an opposing edge of the aperture and a second strut connecting a second side edge of the lever element to an opposing edge of the aperture. The first strut and the second strut are both located closer to the free end of the lever element than the first end of the lever element, and the aperture is open around the lever element in the absence of the second plastic of the seal element. In some embodiments, the first strut and the second strut are formed of the first plastic and are encased within the second plastic of the seal element.

Some embodiments of the spray head assemblies described herein include a gasket that extends around the inlet end edge of the barrel frame.

In another aspect, some embodiments of the liquid spray guns described herein include a liquid spray gun platform as described herein and any of the spray head assemblies as described herein. In some embodiments, the liquid spray gun platform includes: a frame having a barrel interface; an air supply manifold contained within the frame, the air supply manifold having an inlet port; a fan control air passage in fluid communication with the air supply manifold, the fan control air passage extending through the frame from an inlet end at the air supply manifold to an outlet end at the barrel interface; and a center air passage in fluid communication with the air supply manifold, the center air passage extending through the frame from an inlet end at the air supply manifold to an outlet end at the barrel interface. The fan control air passage has a volume that is larger than a volume of the center air passage. In some embodiments, the spray head assemblies include a barrel and an air cap attached to the barrel, wherein the spray head assembly attaches to the barrel interface of the liquid spray gun platform. The spray head assemblies further include: a liquid passageway in the barrel, wherein the liquid passageway extends from an inlet end to a liquid nozzle opening; a center air chamber that extends from a barrel inlet to a center air outlet, wherein the center air outlet is formed between a nozzle aperture in the air cap that surrounds the liquid nozzle opening, wherein the center air chamber includes a nozzle cavity located between the air cap and the barrel, a barrel cavity located within the barrel, and a plurality of openings formed in the barrel through which air passes into the nozzle cavity from the barrel cavity for delivery to the center air outlet during use of the spray head assembly, and wherein the nozzle cavity, the liquid nozzle opening, and the nozzle aperture are shaped to direct air under greater than atmospheric pressure against liquid flowing out of the liquid nozzle opening to propel the liquid away from the liquid nozzle opening while shaping the liquid into a generally conical stream about an axis extending through the liquid nozzle opening; and a fan control air chamber that extends from an inlet end of a fan control barrel passage formed in the barrel to apertures located on horns projecting past the liquid nozzle opening, wherein the apertures in the horns are located on opposite sides of the axis such that air flowing through the fan control air chamber under greater than atmospheric pressure flows against opposite sides of a stream of liquid formed by air flowing through the center air chamber. The center air chamber of the spray head assembly has a volume that is greater than a volume of the fan control air chamber.

In some embodiments of the liquid spray guns described herein, the fan control air passage in the platform and the fan control air chamber in the spray head assembly have a combined volume that is less than a combined volume of the center air passage in the platform and the center air chamber in the spray head assembly. In some embodiments, the fan control air passage in the platform and the fan control air chamber in the spray head assembly have a combined volume that is 75% or less of a combined volume of the center air passage in the platform and the center air chamber in the spray head assembly. In other embodiments, the fan control air passage in the platform and the fan control air chamber in the spray head assembly have a combined volume that is 50% or less of a combined volume of the center air passage in the platform and the center air chamber in the spray head assembly.

In some embodiments of the liquid spray guns described herein, the volume of the fan control air passage and the volume of the center air passage together are less than a volume of the air supply manifold. In some embodiments, the volume of the center air chamber of the spray head assembly is 200% or more of the volume of the fan control air chamber. In other embodiments, the volume of the center air chamber of the spray head assembly is 300% or more of the volume of the fan control air chamber.

In some embodiments of the liquid spray guns described herein, the spray head assembly is operably attached to the barrel interface of the liquid spray gun platform by a protrusion that cooperates with an opening provided in the liquid spray gun platform. Further, the barrel of the spray head assembly includes a barrel frame; a seal element attached to the barrel frame; and a connection tab that comprises the protrusion. The connection tab further includes an aperture formed in a wall of the barrel frame, wherein the barrel frame has a continuous inlet end edge defining a closed perimeter; a lever element located within the aperture, wherein the lever element includes a first end connected to the barrel frame, a free end, and a pair of side edges extending from the first end towards the free end. The seal element closes the aperture around the side edges and the free end of the lever element of the connection tab. In some embodiments, the barrel frame is constructed from a first plastic and the seal element is constructed of a second plastic, wherein the second plastic of the seal element is attached to the first plastic of the barrel frame.

In some embodiments of the liquid spray guns described herein, the aperture includes an opening formed through the wall of the barrel frame, and the connection tab includes a strut connecting a side edge of the lever element to an opposing edge of the aperture, wherein the strut is located closer to the free end of the lever element than the first end of the lever element, and wherein the aperture is open around the lever element in the absence of the second plastic of the seal element. In some embodiments, the strut is formed of the first plastic and is encased within the second plastic of the seal element.

In some embodiments of the liquid spray guns described herein, a gasket extends around the inlet end edge of the barrel frame.

As used herein, the term "liquid" refers to all forms of flowable materials that can be applied to a surface using a spray gun (whether or not they are intended to color the surface) including (without limitation) paints, primers, base coats, lacquers, varnishes and similar paint-like materials as well as other materials such as adhesives, sealers, fillers, putties, powder coatings, blasting powders, abrasive slurries, mold release agents and foundry dressings which may be applied in atomized or non-atomized form depending on the properties and/or the intended application of the material and the term "liquid" is to be construed accordingly.

As used herein, the term "plastic" refers to any polymeric material that is sufficiently tough, resilient and stiff under conditions of use, including polyurethanes, polyolefins, polyamides, polyesters or fluoropolymers. Preferred embodiments include nylon, and more particularly, filled nylon containing glass fiber, glass or polymeric bubbles or microbubbles, electrically conductive and/or static dissipating additives such as finely divided metals, metal salts, metal oxides, carbon or graphite.

The words "preferred" and "preferably" refer to embodiments of the liquid spray guns and components described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

The above summary is not intended to describe each embodiment or every implementation of the spray gun systems described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
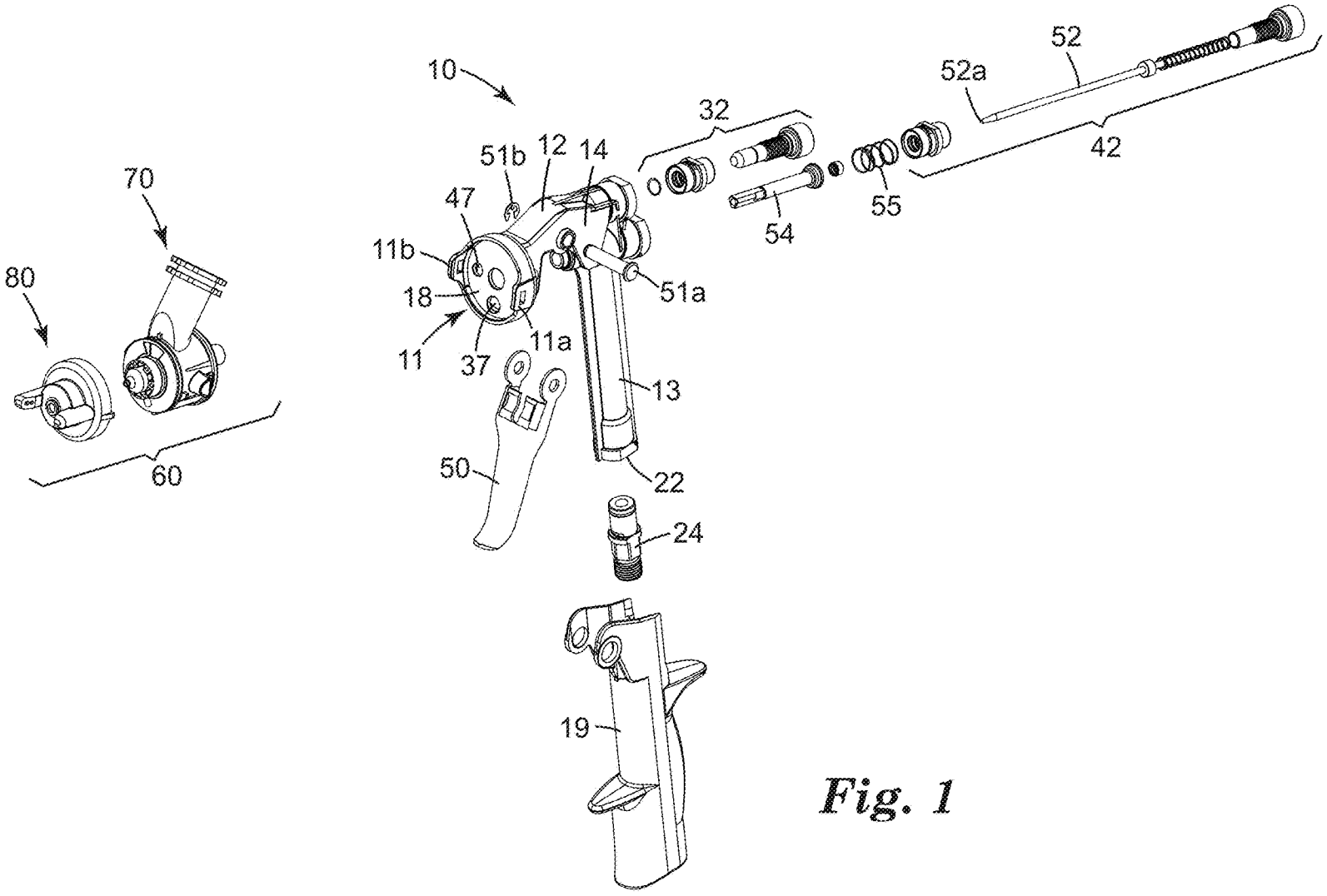
FIG. 1 is an exploded perspective view of one embodiment of a liquid spray gun as described herein.

In the following detailed description of illustrative embodiments of the liquid spray guns and components, reference is made to the accompanying figures of the drawing which form a part hereof, and in which are shown, by way of illustration, specific embodiments in which the liquid spray guns and components described herein may be practiced. It is to be understood that other embodiments may be utilized and structural changes may be made without departing from the scope of the present invention.

One embodiment of a liquid spray gun as described herein is depicted in the exploded view of FIG. 1. The same liquid spray gun is depicted as assembled in FIG. 2. The liquid spray gun includes a variety of components including a liquid spray gun platform 10 and a spray head assembly 60 that is preferably releasably attached to the liquid spray gun platform 10 at a barrel interface 11. The spray head assembly 60 is preferably releasably attached to the platform 10 and provides features that control movement of both the liquid to be sprayed and the air used to spray the liquid as described herein. Preferably, the spray head assembly 60 is disposable and can be thrown away after use (although in some instances it may be reused). If disposed after use, cleaning of the spray head assembly can be avoided and the spray gun can be changed over to dispense another liquid by attaching a different spray head assembly connected to the same or a different liquid container.

Connection of the spray head assembly 60 to barrel interface 11 of the spray gun platform 10 may be achieved by any suitable technique. For example, connection structures on the spray head assembly 60 may cooperate (e.g., mechanically interlock) with the openings 11*a* and 11*b* at the barrel interface 11 to retain the spray head assembly 60 on the spray gun platform 10 as described herein. Many other connection techniques and/or structures may be used in place of those described herein, e.g., a bayonet type connection that facilitates rapid connection/disconnection of the spray head assembly with a simple push or push-twist action, clamps, threaded connections, etc.

The spray gun platform 10 may also include an optional handle 19 that fits over the stem portion 13 of the frame 12. The handle 19 may, in some embodiments, be custom designed according to the operator's preference, including custom fitting by means of a thermosetting resin. Custom-fitted handles may reduce operator fatigue by allowing for a grip surface that can be custom molded to fit the hand of an individual user. The handle may be formed from a thermosetting resin and an intended user of the spray gun can grasp the handle while the resin is in an unhardened condition to impart a contoured surface to the handle that is customized for the hand of that user. In those embodiments in which the handle 19 is detachable from the frame 12, similar handles can be readily prepared for other users of the spray gun which allows a single spray gun to be accompanied by an array of handles, each of which has a grip surface that has been custom-fitted to the hand of a different intended user.

The platform 10 includes a frame 12, a left cover plate 14, a right cover plate 16, and a barrel interface plate 18. The cover plates 14 and 16 and the barrel interface plate 18 are depicted as attached to the frame 12 in FIGS. 1 and 2, but detached from the frame 12 in FIGS. 3A and 3B. The various components may be connected to each other by any suitable technique or combination of techniques. Examples of some potentially suitable connection techniques may include, e.g., welding (thermal, chemical, etc.), adhesives (epoxies, etc.), mechanical fasteners, etc. In some embodiments, the frame 12, cover plates 14 and 16, and barrel interface plate 18 are all constructed of one or more plastics that are amenable to thermal welding such as, e.g., ultrasonic welding.

Although the platform 10 may preferably be constructed of plastic materials, the spray gun platforms described herein may be constructed of any suitable material that can be molded, cast, etc. to form the features described herein. Examples of some potentially suitable materials may include, e.g., metals, metal alloys, plastics (e.g., polycarbonates, nylons (e.g., amorphous nylons), polypropylenes, etc.), and others. If plastic materials are used to construct the platforms, the plastic material may include any suitable additives, fillers, etc. Selection of the materials used in the platforms described herein may preferably be based at least in part on the compatibility of the selected materials with the materials to be sprayed (e.g., solvent resistance and other characteristics may need to be considered when selecting the materials used to construct the platforms).

Figure 4:
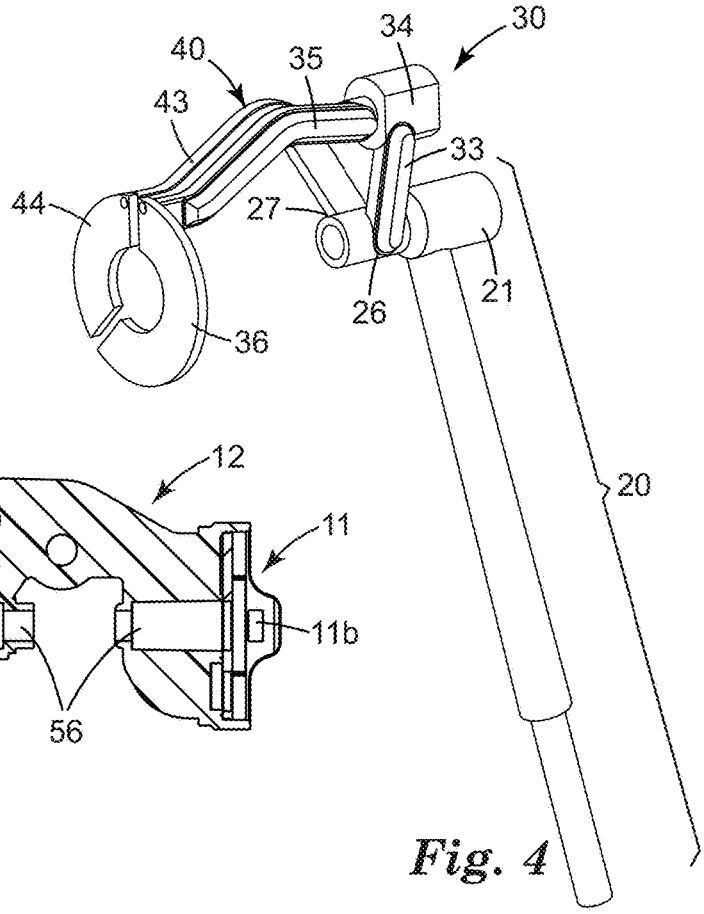
FIG. 4 depicts the volumes of the air supply manifold, the center air passage, and the fan control air passage within the liquid spray gun platform of FIG. 1.

The spray gun platform 10, as assembled, defines a variety of cavities that, taken together, form the passages that deliver air to the spray head assembly. FIG. 4 depicts the cavities/air passages formed in the spray gun platform 10 with the surrounding structure of the platform 10 removed for clarity. Among the cavities/passages formed in the spray gun platform 10 are an air supply manifold 20, a fan control air passage 30, and a center air passage 40.

Figure 6:
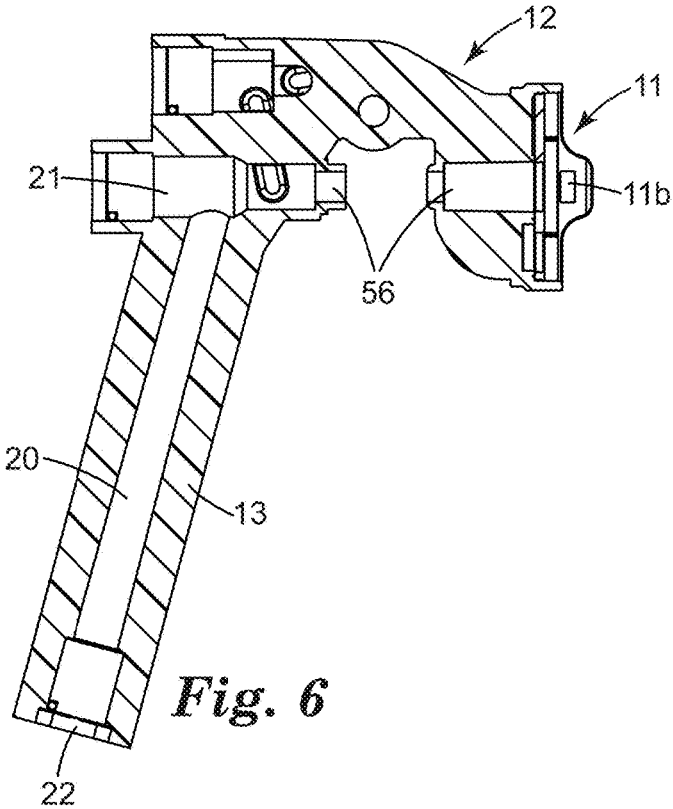
FIG. 6 is a cross-sectional view of the liquid spray gun platform of FIGS. 1 and 2 taken along line 6-6 in FIG. 5.
Figure 5:
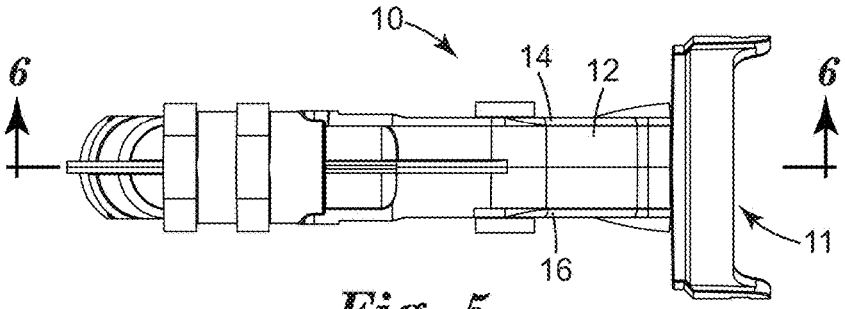
FIG. 5 is a top plan view of the liquid spray gun platform depicted in FIG. 1.

The air supply manifold 20 can be seen in the cross-sectional view of FIG. 6 which is taken along line 6-6 in FIG. 5. The air supply manifold 20 includes a terminal portion 21 to which the fan control air passage 30 and the center air passage 40 connect. Referring to FIG. 1, the air supply manifold 20 includes an inlet port 22 that may include a fitting 24 such that the air supply manifold 20 can be connected to an air source (not shown) that supplies air to the air supply manifold 20 at greater than atmospheric pressure.

The cross-sectional view of FIG. 6 also depicts the needle passage 56 formed through the frame 12 to allow the needle 52 (see FIG. 1) to pass into a spray head assembly attached to the barrel interface The air supply manifold 20 is in fluid communication with the fan control air passage 30 and the center air passage 40 within the spray gun platform 10 so that air flowing into the air supply manifold 20 can be distributed to the fan control air passage 30 and the center air passage 40. Control over the air distribution from the air supply manifold 20 to the fan control air passage 30 may be accomplished by any suitable structures.

Figure 2:
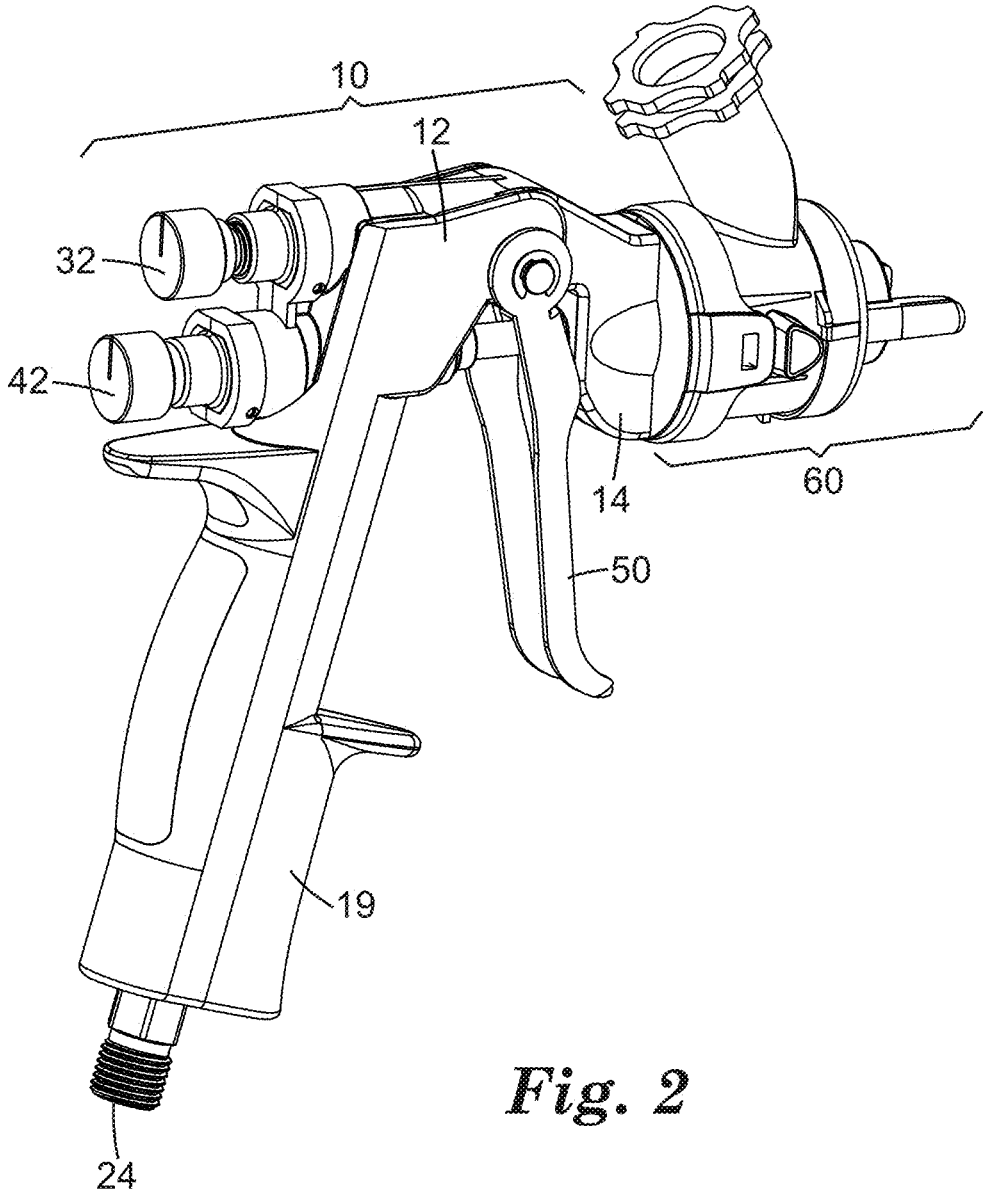
FIG. 2 is a perspective view of the liquid spray gun of FIG. 1 after assembly.
Figure 3A:
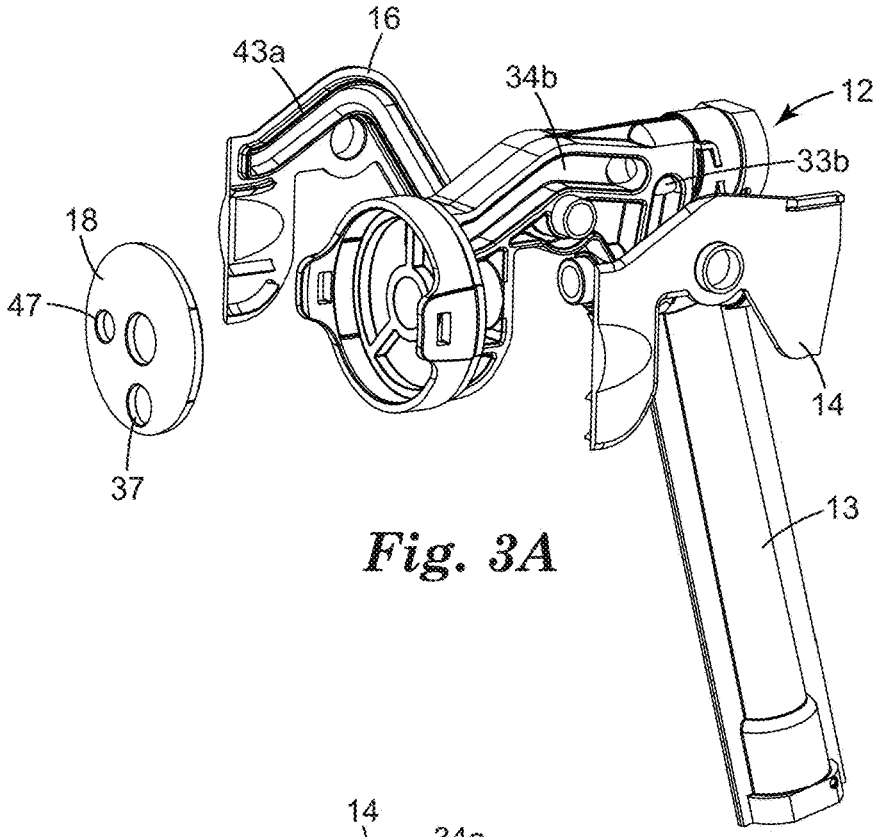
FIG. 3A is an exploded perspective view of the liquid spray gun platform of FIG. 1 taken from a left side of the platform.
Figure 3B:
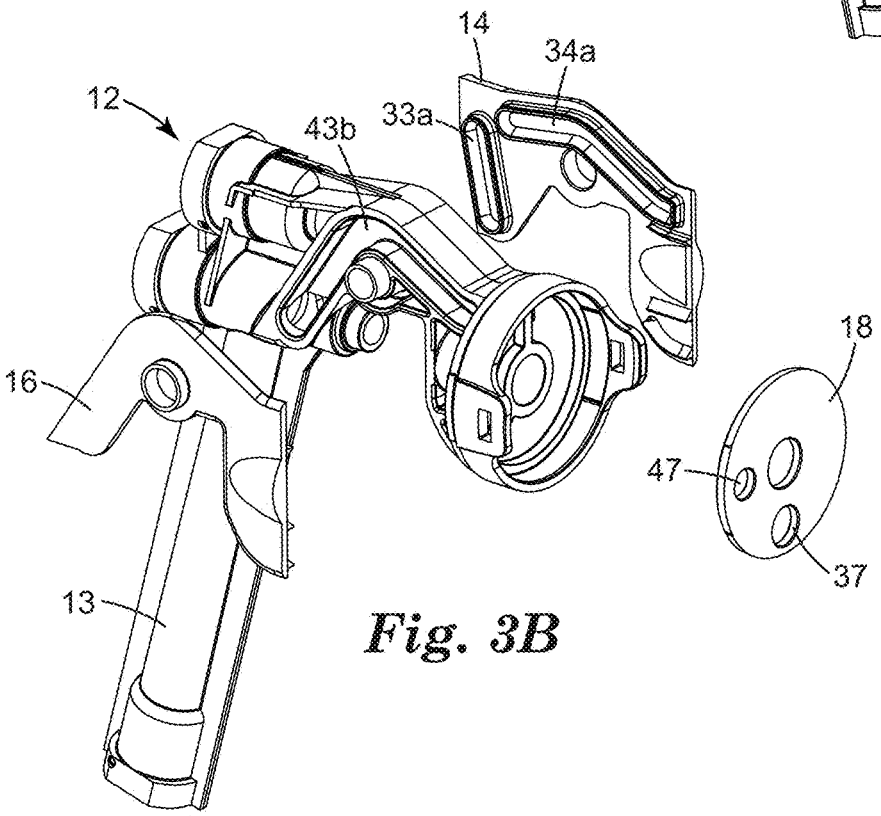
FIG. 3B is an exploded opposing perspective view of the liquid spray gun platform of FIG. 1 taken from the right side of the platform.

Referring to FIGS. 1 and 2, control over both air flow and liquid flow through the liquid spray gun is, in the depicted embodiment, provided by a trigger 50 that is pivotally engaged to the spray gun platform 10 by a retaining pin 51*a* and clip 51*b* (although any other suitable connection mechanism could be used). A needle 52 extends through the spray head assembly 60 in a manner similar to that described in, e.g., U.S. Pat. No. 7,032,839. The trigger 50 is preferably biased to the inoperative position in which needle 52 closes the liquid nozzle opening in the spray head assembly 60 and also closes the air supply valve 54. In the depicted embodiment, the biasing force is provided by a coil spring 55, although other biasing mechanisms may be used.

When the trigger 50 is depressed, needle 52 is retracted to a position in which the tapered front end 52*a* allows liquid to flow through liquid nozzle opening in the spray head assembly 60. At the same time, air supply valve 54 also opens to deliver air to the spray head assembly 60 from the air supply manifold 20. Air and liquid flow may be further controlled by a fan control air regulator assembly 32 which controls air delivered to the fan control air passage 30 from the air supply manifold 20 and center air regulator assembly 42 which controls air delivered to the center air passage 40 from the air supply manifold 20. In particular, the regulator assembly 42 controls the center air/liquid stream emanating from the spray head assembly, and regulator assembly 32 controls air flow to air horns of the spray head assembly 60 to adjust the spray pattern geometry. In some embodiments, however, it should be understood that adjustment of the center air regulator 42 may affect air flow through the fan control regulator assembly 32.

The fan control air passage 30 of the spray gun platform 10 includes a first portion 33 that is in fluid communication with the air supply manifold 20 at location 26 (see, e.g., FIG. 4). The first portion 33 of the fan control air passage 30 leads to a second portion 34, followed by a third portion 35 and a fourth portion 36. The fourth portion 36 is located behind the barrel interface plate 18 of the spray gun platform 10 (see, e.g., FIG. 3A). In the depicted embodiment, the second portion 34 of the fan control air passage 30 provides space for the regulator assembly 32. Air flowing through the fan control air passage 30 thus passes from the air supply manifold 20 into and through the different portions of the fan control air passage 30 until it exits the fan control air passage 30 through fan control air passage outlet 37 formed in the barrel interface plate 18.

The fan control air passage 30 of the spray gun platform 10 is defined, in the depicted embodiment, by the platform frame 12, the left cover plate 14, and the barrel interface plate 18 when those components are attached to each other. It may be preferred that the left cover plate 14 include one or more features designed to mate with one or more cavities in the frame 12 to form the various portions of the fan control air passage 30. For example, the cover plate 14 may include raised rib 33*a* (see FIG. 3B) that, in combination with the cavity 33*b* (see FIG. 3A), defines the first portion 33 of the fan control air passage 30. The fan control air passage 30 then passes through the frame 12 until it reaches the cavity 34*b* formed in the frame 12. The cover plate 14 also includes rib 34*a* (see FIG. 3B) that, in combination with the cavity 34*b* (see FIG. 3A) defines the second portion 34 of the fan control air passage 30. The ribs 33*a* and 34*a* may preferably be provided in the form of closed geometric figures and sealed around the edges of their respective cavities 33*b* and 34*b* to form the portions 33 and 34 of the fan control air passage 30. The sealing may be accomplished by any suitable technique or combination of techniques, e.g., welding (thermal, chemical, etc.), adhesives (epoxies, etc.), mechanical fasteners, etc.

The center air passage 40 of the spray gun platform 10 includes a first portion 43 that is in fluid communication with terminal portion 21 of the air supply manifold 20 at location 27 (see, e.g., FIG. 4). The first portion 43 of the center air passage 40 leads to a second portion 44. The second portion 44 of the center air passage 40 is located behind the barrel interface plate 18 of the spray gun platform 10 (see, e.g., FIG. 3A). Air flowing through the center air passage 40 thus passes from the air supply manifold 20 into and through the portions of the center air passage 40 until it exits the center air passage 40 through center air passage outlet 47 formed in the barrel interface plate 18.

The center air passage 40 of the spray gun platform 10 is defined, in the depicted embodiment, by the platform frame 12, the right cover plate 16, and the barrel interface plate 18 when those components are attached to each other. It may be preferred that the right cover plate 16 include one or more features designed to mate with one or more cavities in the frame 12 to form the various portions of the center air passage 40. For example, the cover plate 16 may include raised rib 43*a* (see FIG. 3A) that, in combination with the cavity 43*b* (see FIG. 3B), defines the first portion 43 of the center air passage 40. The rib 43*a* may preferably be provided in the form of a closed geometric figure that is sealed around the edges of cavity 43*b* to form the portion 43 of the center air passage 40. The sealing may be accomplished by any suitable technique or combination of techniques, e.g., welding (thermal, chemical, etc.), adhesives (epoxies, etc.), mechanical fasteners, etc.

If welding (e.g., ultrasonic welding) is used to attach the left cover plate 14 to the frame 12 along the raised ribs 33*a* and 34*a*, one or both of the connections between the frame 12 and the raised ribs 33*a* and 34*a* may be characterized as defining a fan control air passage weld line, wherein the fan control air passage weld line forms a closed geometric figure between the left cover plate 14 and the frame 12. Similarly, if welding (e.g., ultrasonic welding) is used to attach the right cover plate 16 to the frame 12 along the raised rib 43*a*, the connection between the frame 12 and the raised rib 43*a* may be characterized as defining a center air passage weld line, wherein the center air passage weld line forms a closed geometric figure between the right cover plate 16 and the frame 12. The use of weld lines to seal the passages in the spray gun platform may provide advantages over other sealing techniques such as, e.g., gaskets, etc. which may further improve the airflow performance of the spray gun platform 10.

Although the depicted embodiment of spray gun platform 10 includes a frame 12 and two cover plates 14 and 16, in other embodiments including a frame and cover plate construction, the spray gun platform may include only a single cover plate to define one or more of the passages in combination with the frame. In still other embodiments, the frame may be combined with three or more cover plates to complete the spray gun platform. In still other embodiments, the frame may be constructed in one or more parts such that no cover plates are needed to complete the spray gun platform.

As discussed herein, the spray gun platform 10 may provide advantages over conventional spray gun platforms. Some of the potential advantages may be provided by molding the frame 12 of the spray gun platform 10 from a plastic material, such that the frame 12 is provided as a one piece, completely integral body with cavities formed as needed to define the various air passages through the platform 10. The molding process may provide the opportunity to reduce sharp edges and other features along the passages that may adversely affect fluid flow through the passages. Molding the frame 12 may also present an opportunity to reduce or eliminate secondary machining operations while also providing interior air passage surfaces that are smoother and more conducive to fluid flow through the platform.

Another feature of the spray gun platform as depicted in FIGS. 1-6 is significantly increased dimensions for the air passages formed in the platform 10 as compared to conventional spray gun platforms. Referring to FIG. 4, for example, the platform 10 may include an air supply manifold 20 that has a volume of 0.536 $in^3$ (about 8.8 cubic centimeters (cc)), a fan control air passage 30 that has a volume of 0.258 $in^3$ (about 4.2 cc), and a center air passage 40 that has a volume of 0.154 $in^3$ (about 2.5 cc).

Although the actual volumes of the different features in the spray gun platform 10 may vary in different embodiments, the volumes of the features in the platform 10 may be characterized relative to each other. For example, in some embodiments, the fan control air passage 30 comprises a volume that is larger than a volume of the center air passage 40. In some embodiments, the volume of the fan control air passage 30 is 120% or more of the volume of the center air passage 40. In other embodiments, the volume of the fan control air passage 30 is 150% or more of the volume of the center air passage 40.

The spray gun platform 10 may further be characterized in relative volumetric terms where the volume of the fan control air passage 30 and the volume of the center air passage 40 together are less than the volume of the air supply manifold 20. Although the combined volumes of the fan control air passage 30 and the center air passage 40 may be less than the volume of the air supply manifold 20, they may still have some lower limit. For example, in some embodiments, the volume of the fan control air passage 30 and the volume of the center air passage 40 together are 50% or more of the volume of the air supply manifold 20. In other embodiments, the volume of the fan control air passage 30 and the volume of the center air passage 40 together are 60% or more of the volume of the air supply manifold 20. In still other embodiments, the volume of the fan control air passage 30 and the volume of the center air passage 40 together are 70% or more of the volume of the air supply manifold 20.

In addition to the volumetric characteristics described herein, the fan control air passage 30 may have an average cross-sectional area (where the average cross-sectional area is measured in a plane that is transverse to the air flow through the passage at the geometric center of the measuring location) that is the same as, larger than, or smaller than the average cross-sectional area of the center air passage 40.

Having thus described the spray gun platform 10 and its various features, illustrative embodiments of the spray head assemblies 60 that may be used with the spray gun platforms 10 to provide a complete liquid spray gun can be described. Although the embodiment of the spray head assembly 60 described herein may be advantageously used with the spray gun platforms 10, other spray head assemblies may be substituted for those described herein to provide a complete liquid spray gun.

Figure 7:
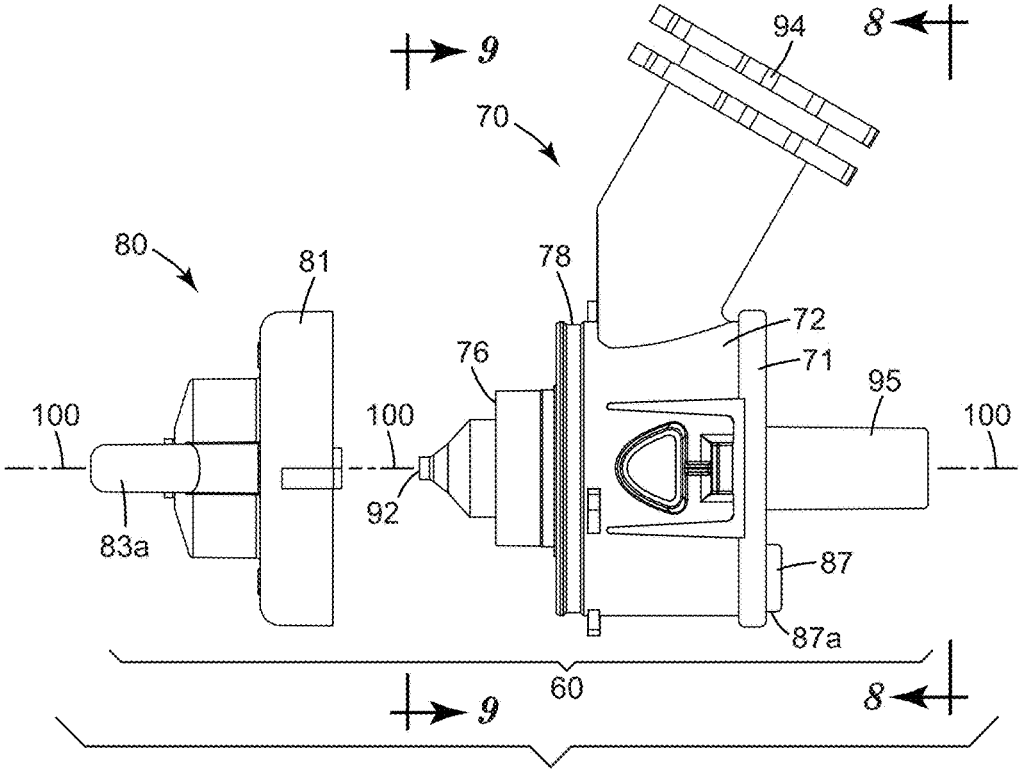
FIG. 7 is an exploded side view of one embodiment of a spray head assembly as described herein.

As seen in FIGS. 1 and 7, the spray head assembly 60 may be provided in the form of a combination of two different components that are connected to each other to form the completed spray head assembly 60. More specifically, the spray head assembly 60 may include both a barrel 70 and an air cap 80. The barrel 70 and the air cap 80 of the spray head assembly 60 preferably combine to form cavities that deliver the center air and the fan control air in a substantially isolated manner through the spray head assembly.

Referring to FIGS. 7-10, the barrel 70 includes a barrel inlet 71 that, in the depicted embodiment, preferably seals within the barrel interface 11 on the spray gun platform 10. The barrel inlet 71 is formed by the barrel wall 72 that in the depicted embodiment is largely in the form of a right circular cylinder (although other shapes could be used).

The barrel 70 also includes features that define a liquid passageway 91 (see FIG. 10) that terminates in a liquid nozzle opening 92 through which the liquid to be sprayed exits the barrel 70. Liquid enters the liquid passageway 91 from the liquid inlet passage 93 that is fed through liquid port 94. The liquid passageway 91 through the barrel 70 is, perhaps, best seen in the cross-sectional view of FIG. 10 (although it should be understood that the air cap 80 has been rotated ninety degrees about the spray axis 100 in the cross-section view). The liquid passageway 91 defined in the barrel 70 is preferably largely isolated from the barrel chamber 73 formed within the barrel wall 72. The liquid passageway 91 is preferably sized to receive a needle 52 (see, e.g. FIG. 1) that is capable of closing the liquid nozzle opening 92 when advanced in the forward direction (to the left in the views depicted in FIGS. 1 and 10) and opening the liquid nozzle opening 92 when retracted in the rearward direction (to the right in FIGS. 1 and 10). The liquid passageway 91 may further include a needle housing extension 95 that extends rearward of the barrel 70 and may preferably fit within the needle passage 56 in the frame 12 (see, e.g., FIG. 6).

The barrel wall 72 of the barrel 70 defines a barrel cavity 73 that surrounds the liquid passageway 91. The barrel cavity 73 receives air flowing out of the center air passage outlet 47 (see, e.g., FIG. 1) in the barrel interface 11 of the spray gun platform 10. As a result, the barrel cavity 73 defines a portion of a center air chamber within the spray head assembly 60. The center air entering the barrel cavity 73 passes through the barrel 70 and exits the barrel cavity 73 through openings 74 provided in the barrel 70.

The barrel wall 72 is attached to the wall of the liquid passageway 91 by optional webs 77 that provide for additional structural integrity of the barrel 70, but that are not so large as to divide the barrel cavity 73 into independent cavities within the barrel 70. Two of the webs 77 are depicted in cross-section in FIG. 10 where it can be seen that they do not extend over the full length of the barrel cavity 73. As a result, the full volume of air in the barrel cavity 73 is available for delivery to the nozzle cavity 75 through the openings 74 as discussed herein.

The openings 74 in the barrel 70 deliver the center air exiting the barrel cavity 73 to a nozzle cavity 75 formed between the air cap 80 and the front wall 76 of the barrel 70. Air entering the nozzle cavity 75 flows through the nozzle cavity 75 until it exits the nozzle cavity 75 though a center air outlet 62 formed between a nozzle aperture 82 in the air cap 80 and the liquid nozzle opening 92. The center air outlet 62 may preferably surround the liquid nozzle opening 92 such that the center air passing through the center air outlet 62 can form the liquid passing through the liquid nozzle opening 92 into a generally conical stream.

Together, the barrel cavity 73 and the nozzle cavity 75 combine to form what can be characterized as the center air chamber of the spray head assembly 60. As described herein, the center air chamber essentially extends from the barrel inlet 71 to the center air outlet 62 of the spray head assembly 60. The center air outlet 62 is formed between the nozzle aperture 82 in the air cap 80 that surrounds the liquid nozzle opening 92. The center air chamber includes the nozzle cavity 75 located between the air cap 80 and the barrel 70. The center air chamber also includes the barrel cavity 73 located within the barrel 70 and the openings 74 formed through the front wall 76 of the barrel 70 through which air passes into the nozzle cavity 75 from the barrel cavity 73 for delivery to the center air outlet 62 during use of the spray head assembly 60. The nozzle cavity 75, the liquid nozzle opening 92, and the nozzle aperture 82 are shaped to direct the center air under greater than atmospheric pressure against liquid flowing out of the liquid nozzle opening 92 to propel the liquid away from the liquid nozzle opening 92 while shaping the liquid into a generally conical stream about an axis 100 extending through the liquid nozzle opening 92.

The air cap 80 that is provided as a part of the spray head assembly 60 is depicted in FIGS. 1, 7, 10, and 11. The air cap 80 is preferably attached to the barrel 70 in a manner that allows for rotation of the air cap 80 about the axis 100 relative to the barrel 70. Examples of this rotation are demonstrated in the rotation of the air cap 80 over an arc of ninety degrees from its orientation in FIG. 7 to its orientation in the cross-sectional view of FIG. 10. Rotation of the air cap 80 may be used to change the orientation of the pattern of the atomized spray emitted from the spray head assembly 60 relative to the axis 100.

Figure 10:
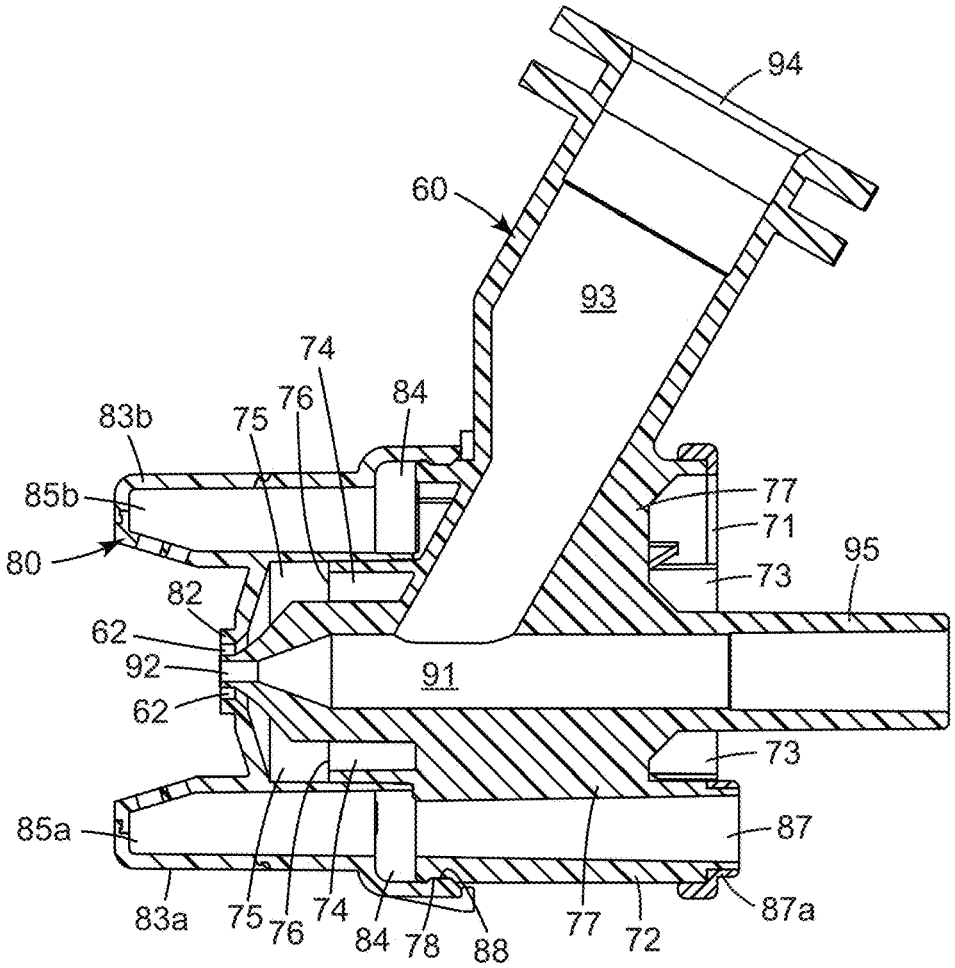
FIG. 10 is a vertical cross-sectional view of the spray head assembly of FIG. 7 as assembled.
Figure 11:
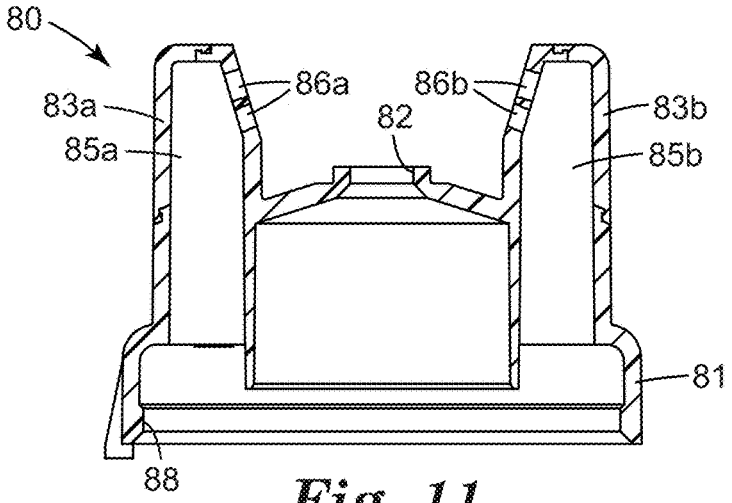
FIG. 11 is a cross-sectional view of the air cap of the spray head assembly of FIG. 10 removed from the barrel.

In the depicted embodiment, the air cap 80 is retained in place over the front wall 76 of the barrel 70 by an interlocking arrangement of the annular recess 78 on the barrel 70 (see, e.g., FIGS. 7 and 10) and a complementary raised annular ridge 88 on the interior surface of the ring 81 of the air cap 80 (see, e.g., FIGS. 10 and 11). The junction between the ring 81 of the air cap 80 and the barrel 70 may preferably have a limited clearance such that leakage of fan control air through that junction is limited and/or to generate some friction to provide a resistive force to rotation of the air cap 80 about the axis 100 (although not so much force as to prevent rotation of the air cap 80 without tools). In some embodiments, a gasket, o-ring, or other seal element may be provided at the junction between the air cap 80 and the barrel 70 to provide additional control over leakage and/or rotational resistance.

As discussed herein, the air cap 80 defines a nozzle cavity 75 at the front wall 76 of the barrel 70. In addition, the air cap 80 also defines cavities that, taken together, make up a portion of a fan control air chamber in the spray head assembly 60. Specifically, the ring portion 81 of the air cap 80 defines a ring cavity 84 located between the ring portion 81 of the air cap 80 and the barrel 70.

The air cap also includes a pair of air horns 83*a* and 83*b*, each of which defines a horn cavity 85*a* and 85*b* (respectively) into which fan air enters from the ring cavity 84. Fan control air delivered into the air horn cavities 85*a* and 85*b* exits the cavities through fan control apertures 86*a* and 86*b* on the air horns 83*a* and 83*b*. The apertures 86*a* and 86*b* on the horns 83*a* and 83*b* are located on opposite sides of the axis 100 such that air flowing through the fan control air chamber under greater than atmospheric pressure flows against opposite sides of a stream of liquid formed by air flowing through the center air chamber. The forces exerted by the fan control air can be used to change the shape of the stream of liquid to form a desired spray pattern. The size, shape, orientation, and other features of the fan control apertures may be adjusted to achieve different fan control characteristics as described in, e.g., U.S. Pat. No. 7,201,336 B2 (Blette). In the depicted embodiment, the fan control apertures 86*a* and 86*b* are in the form of circular bores.

Fan control air is delivered into the fan control air chamber in the spray head assembly 60 from the spray gun platform 10 through fan control air passage outlet 37 in the barrel interface 11 (see, e.g., FIG. 1). Isolation of the fan control air from the center air may be maintained as the fan control air passes through the barrel 70 by directing the fan control air through a fan control barrel passage 87 formed in the barrel 70 (see, e.g., FIG. 10). Air enters the fan control barrel passage 87 through an inlet end 87*a* from the fan control air passage outlet 37 of the platform 10 and is delivered to the ring cavity 84 for distribution to the air horn cavities 85*a* and 85*b*.

Figure 12:
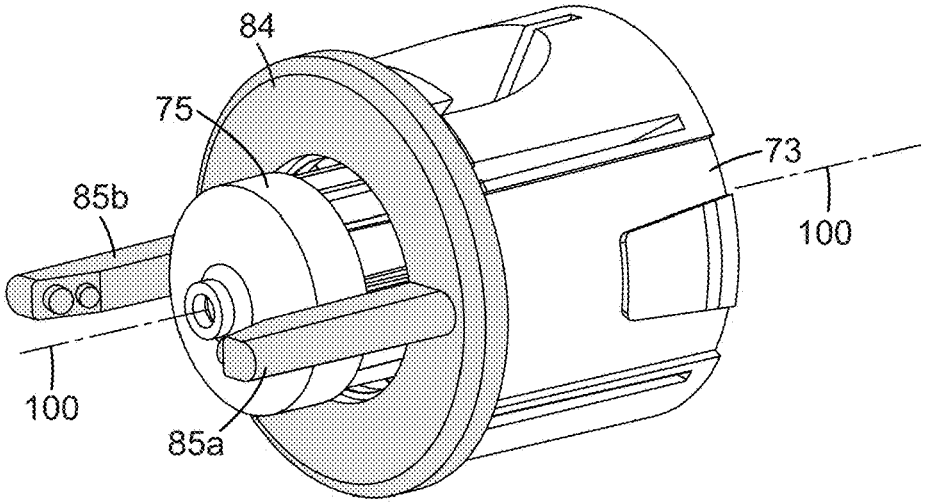
FIG. 12 depicts the volumes of the center air chamber and the fan control air chamber in the spray head assembly as assembled in FIG. 5.

Taken together, the fan control barrel passage 87, the ring cavity 84, and the air horn cavities 85*a* and 85*b* make up the fan control air chamber of the spray head assembly 60. FIG. 12 depicts the cavities/air passages formed in the spray head assembly 60 with the surrounding structure of the barrel 70 and the air cap 80 removed for clarity. Among the cavities/passages formed in the spray head assembly 60 are the barrel cavity 73 and the nozzle cavity 75 that form a part of the center air chamber as described herein. The volumes/cavities that form the openings 74 through which center air passes from the barrel cavity 73 into the nozzle cavity 75 are obscured by the nozzle cavity 75.

Also depicted in FIG. 12 are the ring cavity 84 (shaded) and the air horn cavities 85*a* and 85*b* (also shaded) that form a portion of the fan control air chamber defined within the spray head assembly 60. The volume/cavity formed by the fan control barrel passage 87 (see, e.g., FIG. 10) is not depicted in FIG. 12 because it is obscured by the ring cavity 84 and the barrel cavity 73.

Among the features of the spray head assembly 60 depicted the figures may be significantly increased dimensions for the air chambers formed in the spray head assembly as compared to conventional spray gun platforms. Referring to FIG. 12, for example, the spray head assembly 60 may include an center air chamber that has a volume of 1.059 $in^3$ (about 17.4 cc) and a fan control air chamber that has a volume of 0.255 $in^3$ (about 4.2 cc).

Although the actual volumes of the different features in the spray head assembly 60 may vary in different embodiments, the volumes of the features in the spray head assembly 60 may be characterized relative to each other. For example, in some embodiments, the center air chamber of the spray head assembly 60 may have a volume that is greater than a volume of the fan control air chamber formed in the spray head assembly 60. In some embodiments, the center air chamber of the spray head assembly 60 may have a volume that is 200% or more of the volume of the fan control air chamber in the spray head assembly 60. In other embodiments, the center air chamber of the spray head assembly 60 may have a volume that is 300% or more of the volume of the fan control air chamber.

In some embodiments, the volumes of the air flow features in a platform 10 to which the spray head assembly 60 is attached may be characterized together with the volumes of the features in the spray head assembly. The combined volumes may potentially offer some of the advantages in spray performance as discussed herein.

For example, in a liquid spray gun (which includes a spray gun platform and a spray head assembly) the spray head assembly may have a center air chamber with a volume that is greater than the volume of the fan control air chamber in the spray head assembly. That volumetric relationship may, in some embodiments, be paired with a spray gun platform in which a fan control air passage has a volume that is larger than the volume of the center air passage through the spray gun platform.

In other embodiments, a spray head assembly with a center air chamber with a volume that is greater than the volume of the fan control air chamber in the spray head assembly may be paired with a spray gun platform in which a fan control air passage and the fan control air chamber in the spray head assembly taken together have a combined volume that is less than a combined volume of the center air passage in the spray gun platform and the center air chamber in the spray head assembly.

In still other embodiments, a spray head assembly with a center air chamber with a volume that is greater than the volume of the fan control air chamber in the spray head assembly may be paired with a spray gun platform in which the fan control air passage in the platform and the fan control air chamber in the spray head assembly taken together have a combined volume that is 75% or less of a combined volume of a center air passage in the spray gun platform and the center air chamber in the spray head assembly.

In still other embodiments, a spray head assembly with a center air chamber with a volume that is greater than the volume of the fan control air chamber in the spray head assembly may be paired with a spray gun platform in which the fan control air passage in the platform and the fan control air chamber in the spray head assembly taken together have a combined volume that is 50% or less of a combined volume of a center air passage in the spray gun platform and the center air chamber in the spray head assembly.

In still other embodiments, a spray head assembly with a center air chamber with a volume that is greater than the volume of the fan control air chamber in the spray head assembly may be paired with a spray gun platform in which the volume of a fan control air passage in the spray gun platform and the volume of a center air passage in the spray gun platform taken together are less than the volume of an air supply manifold in the spray gun platform.

In some embodiments, the barrel 70 may include a gasket 111 that preferably extends about an inlet end edge 121 of a barrel frame 120 such that the barrel 70 can be sealed with a barrel interface 11 (see, e.g., FIGS. 1 and 13) when the barrel 70 is attached to a spray gun platform. The barrels 70 may also include a fan control air passage gasket 112 that provides a seal between the fan control barrel passage 87 and the fan control air passage outlet 37 in the barrel interface 11 (see, e.g., FIGS. 1 and 13).

Figure 13:
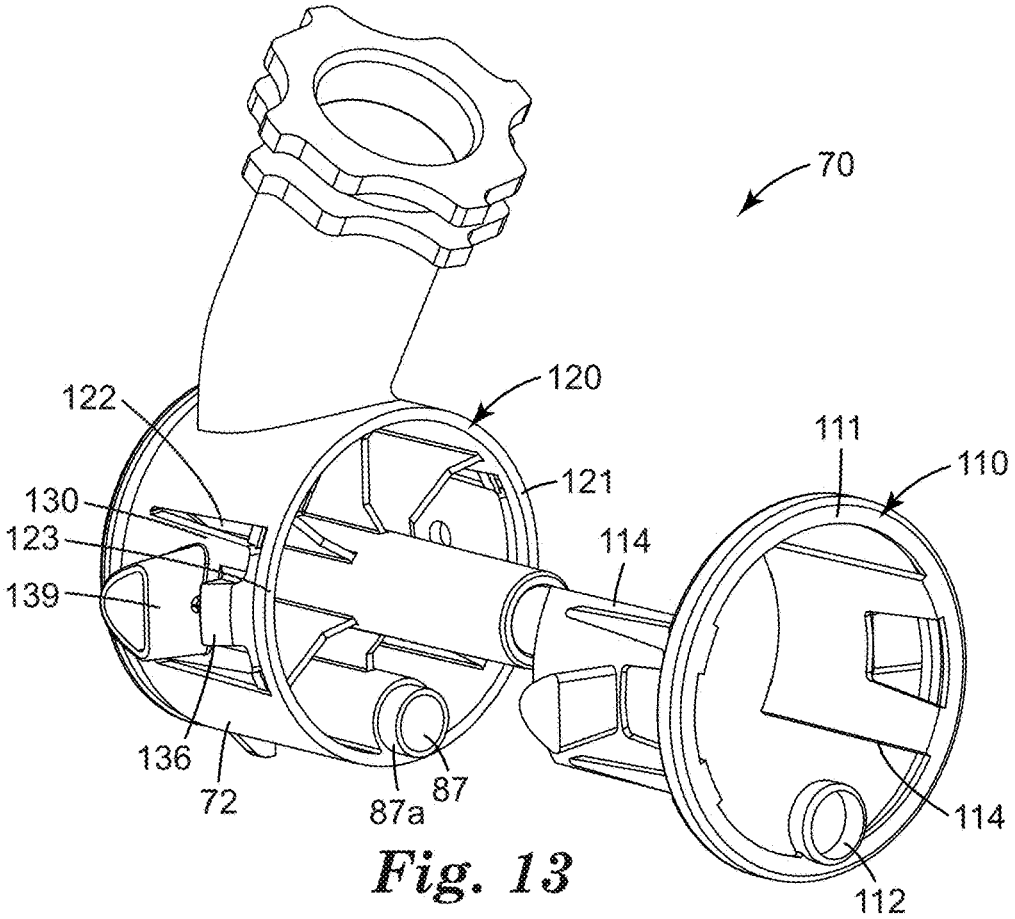
FIG. 13 is an exploded perspective view of one embodiment of a barrel frame and seal element used to construct a barrel used in a spray head assembly as described herein.
Figure 14:
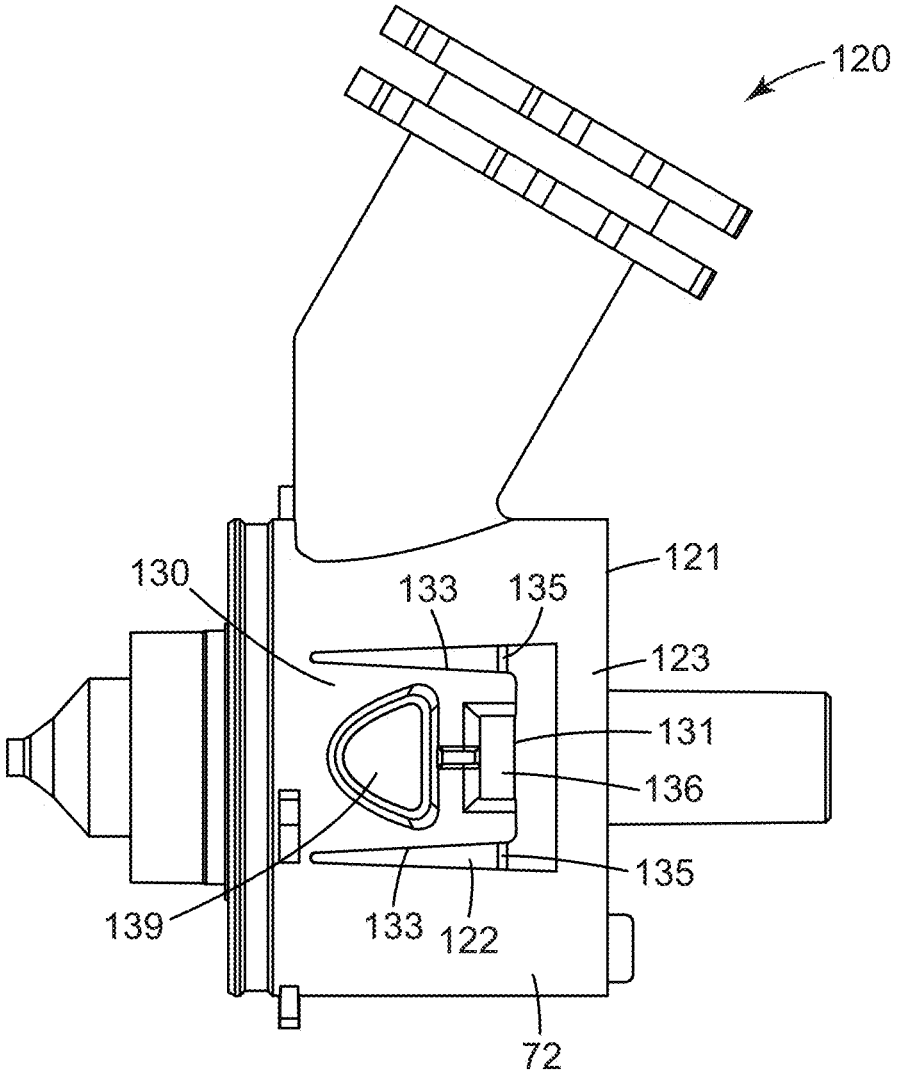
FIG. 14 is a side view of the barrel frame of FIG. 13.

The barrels used in spray head assemblies as described herein may also include, as discussed above, structure to assist with connection and retention of the spray head assembly on a spray gun platform. In the embodiment of the barrel 70 as depicted in FIGS. 7, 13 and 14, the connection structure may take the form of a pair of connection tabs (although in some embodiments a single connection tab and associated lever element may potentially be used to make the connection).

The connection tab structures may preferably be formed in a barrel frame 120 that includes an aperture 122 formed in the barrel wall 72. The aperture 122 may preferably be bounded on all sides of the barrel wall 72. In particular, it may be preferred (but not required) that the aperture 122 be bounded along the inlet edge 121 of the barrel frame 120 by a beam portion 123 spanning the opposing edges of the aperture 122, such that the inlet end edge 121 of the barrel frame 120 is continuous such that the inlet end edge 121 of the barrel frame 120 forms a closed perimeter at inlet end of the barrel 70. In other embodiments, the aperture 122 may extend to the inlet end 121 of the barrel frame 120 such that the inlet end edge 121 does not form a continuous edge or closed perimeter.

A lever element 130 is located within the aperture 122. The lever element 130 may preferably be cantilevered within the aperture 122 such that the lever element 130 has a first end connected to the barrel wall 72/barrel frame 120 and a free end 131 that may not be connected to the beam portion 123 spanning the aperture 122 at the inlet end edge 121 of the barrel frame 120. The lever element 130 also includes a pair of side edges 133 extending from the first end towards the free end 131, wherein the lever element 130 may, in some embodiments, not be attached to the barrel wall 72/barrel frame 120 along the side edges 133.

In the depicted embodiment, a seal element 114 is provided to close the aperture 122 around the lever element 130. The seal element 114 may also assist in biasing the lever elements 130 against inward movement during attachment or detachment of the spray head assemblies on a spray gun platform as described herein. (in addition to sealing barrel cavity 73 between the lever element 130 and the aperture 122 in which it is located).

In some embodiments, the barrel frame 120 may be constructed (e.g., molded) from a first plastic and the seal element 114 may be constructed (e.g., molded) of a second plastic, and the second plastic of the seal element 114 may be attached to the first plastic of the barrel frame 120. In embodiments in which a seal element 114 is constructed of a material (e.g., plastic material) that is different than the material used for the barrel frame 120, attachment of the seal element 114 to the barrel frame 120 to close the aperture 122 may be performed by any suitable technique or combination of techniques, e.g., molding (e.g., insert molding, overmolding, etc.), adhesives (epoxies, etc.), mechanical fasteners, etc.

Although the connection tabs may be described herein as including a lever element 130 located in an aperture 122 with a seal element 114 closing the aperture 122 around the lever element 130, in some embodiments, the seal element 114 and the barrel frame 120 (including the lever element 130) may all be constructed (e.g., molded) of a the same material with the seal element 114 being provided in the form of a thin web of material spanning the aperture 122 between the lever element 130 and the surround edges of the aperture 122. The seal element 114 may, by virtue of its thinner structure, provide the flexibility needed to displace the lever element 130 during attachment and removal of the barrel 70 as described herein. In some embodiments such as this, the seal element 114 may be integrally molded with the barrel frame 120 (e.g., molded in a single shot along with the barrel frame 120).

In some embodiments, the lever elements 130 may include one or more struts 135 that connect a side edge 133 of the lever element 130 to an opposing edge of the aperture 122 in which the lever element 130 is located. In some embodiments, the lever elements 130 may be connected to the surrounding edges of the apertures 122 by a pair of struts 135, wherein each strut 135 connects one of the side edges 133 of the lever element 130 to an opposing edge of the aperture 122. The strut or struts 135 may preferably be located closer to the free end 131 of the lever element 130 than the first end of the lever element 130 (i.e., the end of the cantilevered element 130 that is attached to the barrel frame 120). The strut or struts 135 may, in some embodiments, be encased within the seal element 114 such that the strut is not exposed. The strut or struts 135 may potentially be useful to control deflection of the lever element 130 such that a seal element 110 is not unintentionally detached from the barrel frame 120.

In some embodiments, the barrel frame 120 may be constructed of a first plastic and the seal element 111 may be constructed of a second plastic that is not the same as the first plastic. In some embodiments, the second plastic may be more flexible than the first plastic, e.g., the second plastic may be described as a more elastomeric material as compared to the first plastic used to construct the barrel frame. In some embodiments, the barrel frame 120 may be constructed of, e.g., polypropylene while the seal element is constructed of a thermoplastic elastomer (e.g., SANTOPRENE, etc.). In other embodiments, the seal elements 114 may preferably be constructed of elastomeric plastics such as, e.g., thermoplastic elastomers, thermoplastic urethanes, etc., although other materials may be used if they provide an adequate seal. Another factor that may be used in selecting materials for the barrel frame and seal elements may include the compatibility of the materials in a 2-shot molding process or other manufacturing process used to construct the barrels as described herein. Also, although the barrel frame may be constructed of one or more plastics, in some embodiments, the barrel frame could be constructed of other materials, e.g., metals, metal alloys, etc.

In some embodiments that include a seal element 114 that is constructed of a material that is different than that used to construct the barrel frame 120 and where the seal element 114 is constructed of an elastomeric plastic that provides sealing capabilities, the seal element(s) 114 may be molded in the same shot as other sealing features on the barrel frame 120. In particular, FIG. 13 provides one example of such a construction in which the gasket 111 on the inlet end edge 121 of the barrel frame 120, the seal elements 114, and the fan control air passage gasket 112 are all molded from a single shot of an elastomeric plastic material. In such an embodiment, the sealing features taken together, may form a unitary seal assembly 110.

Figure 8:
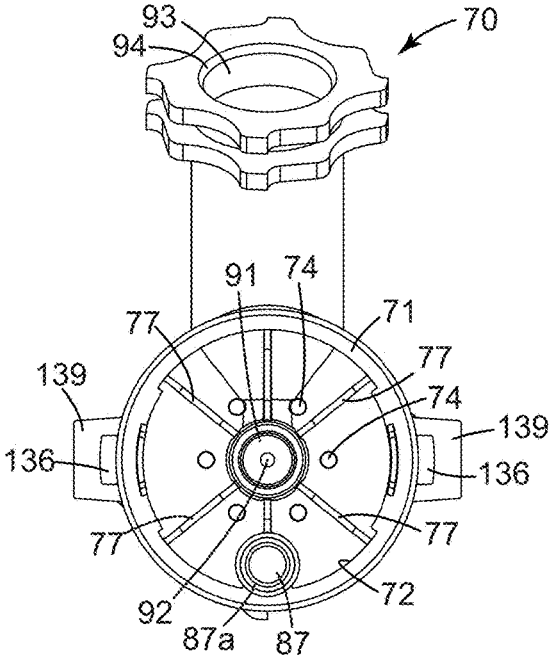
FIG. 8 is a rear view of the barrel taken from the line 8-8 in FIG. 7.
Figure 9:
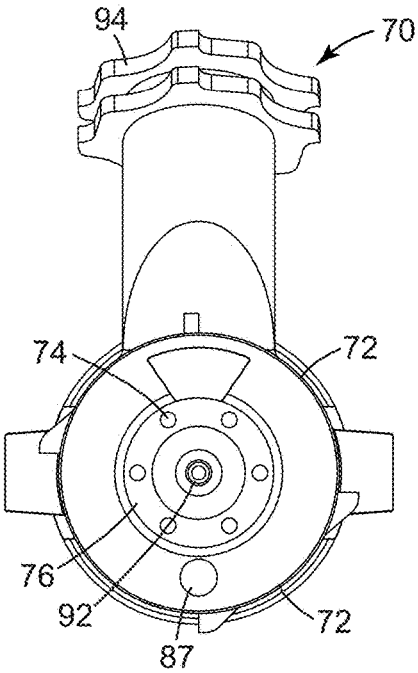
FIG. 9 is a front view of the barrel taken from line 9-9 in FIG. 7.

The lever element 130 of the connection tab also preferably includes a projection 136, wherein the projection 136 extends away from an interior of the barrel frame 120 (see, e.g., FIGS. 8 and 13). The projections 136 may preferably be sized and positioned to fit within the openings 11*a* and 11*b* or other appropriate structures formed in the spray gun platform 10 such that the openings 11*a* and 11*b* and projections 136 cooperate (e.g., mechanically interlock).

The embodiments of the lever elements 130 depicted in connection with the spray head assemblies described herein may also include posts 139 that also extend outwardly from the lever elements to provide a convenient location for a user to place his or her fingers to deflect the lever element 130 and its attached projection 136 inward during attachment or detachment of the spray head assemblies on a spray gun platform as described herein.

The liquid spray guns, spray gun platforms, and spray head assemblies described herein may be used in spray gun systems that may be commonly referred to as gravity-fed spray guns (where the liquid to be sprayed is fed under gravity to the spray head assembly), siphon-fed spray guns (where the liquid to be sprayed is siphoned into the spray head assembly from a reservoir), and/or pressure-fed spray guns (where the liquid to be sprayed is fed under pressure from the reservoir into the spray head assembly). Further, auxiliary components that may be used in connection with the spray guns, spray gun platforms, and spray head assemblies discussed herein, and their respective methods of use, may be described in more detail in, e.g., U.S. Pat. No. 6,820,824 (Joseph et al.); U.S. Pat. No. 6,971,590 (Blette et al.); U.S. Pat. No. 7,032,839 (Blette et al.); U.S. Pat. No. 7,201,336 (Blette et al.); U.S. Pat. No. 7,484,676 (Blette et al.), and in U.S. Patent Application Publication Nos. 2004/0140373 (Joseph et al.); 2006/0065761 (Joseph et al.) and 2006/0102550 (Joseph et al.), etc.

The complete disclosure of the patents, patent documents, and publications cited herein are incorporated by reference in their entirety (to the extent that those teachings do not conflict with the explicit descriptions found herein) as if each were individually incorporated.

Illustrative embodiments of liquid spray guns, liquid spray gun platforms, and liquid spray head assemblies and methods of using them are discussed and reference has been made to possible variations. These and other variations, combinations, and modifications will be apparent to those skilled in the art without departing from the scope of the invention, and it should be understood that this invention is not limited to the illustrative embodiments set forth herein. Rather, the invention is limited only by the claims provided below, and equivalents thereof.

What is claimed is:

1. A disposable, releasably attachable gravity-fed spray gun spray head assembly comprising a liquid port (94) for direct connection to a gravity-fed spray gun paint reservoir;

a liquid nozzle opening (92) for spraying a liquid;

a liquid inlet passage (93) in fluid communication with a liquid passageway (91), the liquid inlet passage and the liquid passageway fluidly connecting the liquid port (94) to the liquid nozzle opening (92);

a barrel frame comprising a connection tab to assist in connection of the spray head assembly to a gravity-fed spray gun platform, wherein the connection tab comprises a lever element (130) comprising a projection (136) extending away from an interior of the barrel frame, wherein the lever element comprises a post (139) extending outwardly from the lever element to provide a user to place a finger to deflect the lever element to attach or detach the spray head assembly to or from a gravity-fed spray gun platform.

2. The spray head assembly of claim 1 wherein the barrel frame (120) comprises an inlet end edge (121) forming a closed perimeter at a barrel inlet.

3. The spray head assembly of claim 2 comprising a gasket (111) on the inlet edge (121).

4. The spray head assembly of claim 1 comprising a barrel inlet, wherein the barrel inlet comprises a fan control barrel passage (87) and a fan control air passage gasket (112) to provide a seal between the fan control barrel passage (87) and a fan control air passage outlet in a gravity-fed spray gun platform.

5. The spray head assembly of claim 4 comprising a gasket (111) on the inlet edge (121), wherein the gasket (111) and the fan control air passage gasket (112) form a unitary seal assembly (110).

6. The spray head assembly of claim 5 wherein the unitary seal assembly (110) comprises an elastomeric plastic material.

7. The spray head assembly of claim 1 wherein the barrel frame (120) comprises an aperture (122) formed in a barrel wall (72), wherein the connection tab is at least partially bounded by the aperture.

8. The spray head assembly of claim 1 wherein the connection tab is located within an aperture (122).

9. The spray head assembly of claim 8 wherein the lever element (130) is cantilevered within the aperture (122) such that the lever element comprises a first end connected to the barrel wall.

10. The spray head assembly of claim 1 wherein the lever element comprises a free end (131) that is not connected to the barrel wall.

11. The spray head assembly of claim 1 further comprising an aperture (122) and a seal element (114) provided to close the aperture 122 around the lever element (130).

12. The spray head assembly of claim 11 comprising a gasket (111) on an inlet edge (121), wherein the gasket (111) and a seal element (114) form a unitary seal assembly (110).

13. The spray head assembly of claim 12 comprising a barrel inlet, wherein the barrel inlet comprises a fan control barrel passage (87) and a fan control air passage gasket (112) to provide a seal between the fan control barrel passage (87) and a fan control air passage outlet in a gravity-fed spray gun platform, wherein the fan control air passage gasket (112), the gasket (111), the seal element (114) form a unitary seal assembly (110).

14. The spray head assembly of claim 11 wherein the unitary seal assembly (110) comprises an elastomeric plastic material.

15. The spray head assembly of claim 1 wherein the projection is sized and positioned to fit within an appropriate structure on a gravity-fed spray gun platform.

16. The spray head assembly of claim 1 wherein the lever element (130) comprises a projection (136) extending away from an interior of the barrel frame, wherein deflection of the post (139) deflects the projection.

17. The spray head assembly of claim 1 wherein the liquid inlet passage is configured such that a liquid drawn through the liquid port in use is delivered to the nozzle in the liquid spray head assembly without passing through the gravity fed spray gun platform.

* * * * *